US006682612B2

(12) United States Patent
Meyer et al.

(10) Patent No.: US 6,682,612 B2
(45) Date of Patent: Jan. 27, 2004

(54) METHOD OF HEAT TREATMENT OF WIRE

(75) Inventors: Meinert Meyer, Erkrath (DE); Uwe Plociennik, Ratingen (DE); Klaus Küppers, Erkrath (DE); Rainer Kohlmann, Siegen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/752,137

(22) Filed: Dec. 20, 2000

(65) Prior Publication Data

US 2001/0011566 A1 Aug. 9, 2001

(30) Foreign Application Priority Data

Dec. 23, 1999 (DE) ..... 199 62 801

(51) Int. Cl.[7] ..... C21D 9/52

(52) U.S. Cl. ..... 148/595; 148/598; 148/600; 148/601; 148/602

(58) Field of Search ..... 148/595, 598, 148/600, 601, 602

(56) References Cited

U.S. PATENT DOCUMENTS 4,180,418 A * 12/1979 Paulitsch et al. ..... 148/598
4,533,401 A * 8/1985 Yutori et al. ..... 148/654
5,302,216 A * 4/1994 Sugita et al. ..... 148/595

FOREIGN PATENT DOCUMENTS

| | | |
|---|---|---|
| BE | 0840896 | 10/1976 |
| DE | 1508443 | 10/1969 |
| DE | 2345738 | 7/1974 |
| DE | 2612918 | 10/1976 |
| DE | 2830153 | 1/1980 |
| DE | 3427557 | 3/1985 |
| EP | 0496726 | 7/1992 |
| EP | 0849369 | 6/1998 |
| FR | 2445858 | 8/1980 |

OTHER PUBLICATIONS

Patent Abstract of Japan of a Publication No. 56–119 728, Sep. 9, 1981.

European Search Report EP00126743, Mar. 5, 2001.

* cited by examiner

*Primary Examiner*—Sikyin Ip
(74) *Attorney, Agent, or Firm*—Sidley Austin Brown & Wood, LLP

(57) ABSTRACT

A method of heat treatment of wire including cooling the wire stock immediately after the stock leaves the rolling heat region to a temperature below the starting temperature of martensite formation and, thereafter, forming wire coils.

4 Claims, No Drawings

METHOD OF HEAT TREATMENT OF WIRE

BACKGROUND OF THE INVENTION

1. Field of the Invention

The present invention relates to a method of heat treatment of wire according to which the rolled stock is wound or reeled into coils or the coils are formed with a laying head. The present invention also relates to an installation for effecting the method.

2. Description of the Prior Act

For producing wire having a diameter from 5 mm to 60 mm, usually a long-length rolled product, after being rolled, is wound, with a so-called Garret coiler, or reeled into coils, or separate windings are formed with a laying head, placed on a roller or chain conveyer, and are assembled into a coil at the conveyor end with an aid of a mandrel.

As a result of cooling of the material which takes place in a coiler or a reel, the wire is characterized by different strength along its length due to different cooling conditions within the coil. The different strength, according to known methods, is either compensated by a subsequent treatment of the coil or is eliminated by a subsequent treatment, e.g., quenching and tempering, of the end product.

German Publication DE 28 30 153A1 discloses a method of heat treatment of wire or strip coiled into rings. The rolled stock is coiled, and the formed coil is cooled. Before the heat treatment, the coil or the strip are brought to a predetermined temperature which, as a rule (for steel), corresponds to the austenitization temperature. Austenitized rings are then hardened by excited sympathetic vibrations and, finally, are tempered.

The drawback of the above-described method consists in that the cooling is not uniform, and the wire is cooled noticeably slowly in the center of the coil than at its edge. As a result, thicker oxide layers are formed on the windings located in the center of the coil than on the edge windings. During a subsequent pickling process necessary before further processing of the wire product, also the inner winding need be freed of the oxide layers. This is connected with a danger that the outer windings with low-oxide layers will be attacked by the pickling acid too severely and will be damaged.

European Publication EP 0 849 369A2 discloses a method of heat treatment of wire or steel rods according to which the rolled stock is coiled in a basket or is placed in form of windings, which are formed with a laying head, on a conveyor band and, at the end of the conveyor, are assembled into a coil with a mandril. In order to prevent the variations during cooling in the coiler or during formation of windings and the resulting inhomogeneous mechanical characteristics, it is proposed to already cool the just rolled product, before coiling or formation of the winding, during the travel of the product along the path from the last rolling stand to the cooling region. This cooling is effected in such a way that the outer surface of the rolled product is not undercooled and, thus, reaches into the region of martensite formation. This cooling should prevent hard spots on the surface of the rolled stock. According to the method disclosed in EP 0 849 369 A2, the rolled stock should be converted from the austenite phase into ferrite/perlite phase almost isothermically.

Accordingly, an object of the present invention is a method of heat treatment of wire and an installation for effecting the method which would prevent a non-uniform structure formation and, thereby, would prevent non-uniform mechanical characteristics over the longitudinal extent of the length of the product.

SUMMARY OF THE INVENTION

This and other objects of the present invention, which will become apparent hereinafter, are achieved by providing a method of heat treatment of wire according to which a steel long-length rolled stock, which has just left the rolling heat region, is cooled to a temperature below a temperature at which martensite formation starts, and then is wound or reeled into a coil, or a coil is formed by using a laying head; and by providing an installation including a rolling mill stand, a device for coiling the rolled stock or laying head means for placing windings on a conveyor and a collection station for forming coils by using a mandrel, which is located downstream of the rolling mill stand, a cooling line located immediately downstream of the rolling mill stand and upstream of the coiling means for cooling the long-length rolled stock leaving the rolling mill stand to a temperature below the temperature of the start of the martensite formation, and a tempering furnace located downstream of the coiling means.

The temperature of the start of the martensite is the temperature at which martensite conversion starts. It is noticeably influenced by an increased carbon content and by alloy additive and is, therefore, depends on special alloy compositions. Only after the rolled stock has been quenched, it is coiled, reeled, or windings are formed. Finally, the tempering step of the quenching and tempering process is effected.

As known, quenching and tempering process, as known, consists of three steps, namely, austenitization of the stock, i.e., of heating-up and heating through of the stock and homogenization of the structure; quenching for obtaining a hard structure; and tempering for improving toughness characteristics. The method according to the present invention eliminates the austenitization step because the wire is cooled immediately after it leaves the rolling heat region. The inventors found out that it was possible to form windings also in the hardened condition and them temper them.

DETAILED DESCRIPTION OF THE PREFERRED EMBODIMENT

In accordance with the inventive method of heat treatment of wire, the rolled stock is cooled under such conditions that its temperature drops below the temperature at which the martensite formation starts but is above the temperature at which the martensite formation is finished and the structure still includes a residual austenite. The coiling process is then effected at or with subsequent isothermal conditions, advantageously, under a hot top, in a predetermined time period. Dependent on the holding time, the remaining residual austenite is diffused or is converted into martensite by the stock being subjected to new, accelerated cooling. By being subjected to isothermal conditions for a predetermined time period, the initially formed martensite structure is stress-relieved. If the wire is cooled only slightly below the temperature of the start of martensite formation and is then coiled or is converted into windings, the conversion of the residual austenite into martensite takes place in the coil. The so formed martensite structure is not shaped as a deformed or distorted tetragonal structure as is the case when the stock is cooled in an accelerated fashion under or below the temperature at which martensite formation is finished. A decelerated cooling after the temperature of the start of martensite formation has been reached results in diffusing of the residual carbon and the low-stress conversion of the emerged martensite into a cubic martensite. This prevents formation of microfissures in the structure which substantially improves the limiting fatigue stress characteristic of the material such as, e.g., 50CrV4.One of the advantages of the inventive method consists in that in steels with proeutectoid carbide precipitation, such as 90 MnCrV8 or X36Mo17, as a result of a high cooling speed, these carbide precipitations are contained at the grain boundaries. This substantially increases the material toughness. Even if, because of a very high precipitation potential, precipitations do have place, e.g., at a high C-content, these precipitations are extremely fine and, therefore, are essentially harmless. This is because an extremely small initial grain of the austerite has a grain surface which is about in 10 times larger than a grain surface obtained with conventional quenching and tempering process.

With the method according to the present invention, during cooling, martensite, which is formed in the edge layer of the longlength rolled stock, is self-tempered by the residual heat in the core. The remaining residual austenite is later converted in the coil into martensite. The inventive method is characterized by a reduced danger of fissure formation and by small stress of the hard structure.

Advantageously, the cooling is conducted at a temperature below the temperature of the start of martensite formation, i.e., at a quenching temperature, after the finishing pass in the rolling mill stand and before the start of the statical recrystalization of the rolled structure. An extremely fine austenite grain, which is obtained after the finishing pass, advantageously influences the toughness characteristics. The last rolling pass preferably takes place at a reduced end rolling temperature.

According to the inventive method the secondary oxide layer, which is formed during the rolling process and is quenched during cooling, is already mechanically removed during coiling or winding formation before the following, if necessary, pickling process. The problem of scale formation in the coil is eliminated because during the quenching process, the material is cooled at a temperature below 400° C. No scale is formed at that temperature. Thereby a known drawback of a prior art method with which, during pickling conducted to insure descaling of the inner windings, an overpickling of the outer winding can take place, is eliminated.

Because according to the inventive method, the rolled stock is subjected to quenching immediately after it leaves the rolling heat region, edge decarburization is prevented. Edge decarburization, which occurs during reheating to austenitization temperatures and, therefore, required high furnace temperatures, adversely affects the end product.

The inventive method prevents, to a large extent, formation of large grains which is connected with the austenitization. Because cooling or quenching of the wire takes place immediately after the wire leaves the rolling heat region and, preferably, before the static recrystallization, the austenite grain is noticeably smaller than the grain obtained during quenching which is effected, after cooling that takes place after the stock leaves the rolling heat zone, at a reheating to an austenitization temperature. The difference in the respective grain sizes lies approximately in the range between 9–10 ASTM and 6–7 ASTM. The structure with a smaller grain size, in addition to increasing strength characteristics of the material, also substantially improves the toughness characteristics of the material.

The present invention also has a positive environmental effect. Steels, which are used in cold forging, are alloyed with boron, and usually are isothermally converted in a salt bath to obtain a cold deformable structure. In addition to occurring strength variations over the wire length, the salt bath is environmentally harmful. The present invention permits to eliminate the salt bath treatment because the steel products, which leave the rolling heat region, are cooled at a temperature below the starting temperature of the martensite formation and then are wound into coils.

The installation for effecting the inventive method includes a cooling line, which is arranged in line immediately downstream of the rolling mill stand for predetermined cooling of the longlength rolled stock to a temperature below the martensite starting temperature, a coiler or a device with a laying head for placing winding on a conveyor at the end of which there is provided a collection station at which coils are formed by using a mandrel, any of which is located downstream of the cooling line, and a tempering furnace, due to fine grain structure of the wire and to the residual heat remaining in the coil, the tempering furnace can be made much shorter than in the conventional quenching and tempering processes.

The method according to the present invention can be advantageously used for heat treatment of 50CrV4 steel and of steel susceptible to quenching and tempering and having proeutectoid carbon precipitation, e.g., such as 90 McCrV8 or X36CrMo17, or of boron-containing steel subjected subsequently to cold deformation for forming springs, screws, shaped parts, etc. The boron-containing steels for cold forging can only be quenched and tempered after they leave the rolling heat region. These steels, after being subjected to cold deformation, have a desired strength without additional quenching and tempering.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A method of heat treatment of wire comprising the steps of:

cooling a long-length wire stock immediately after the stock leaves a rolling heat region to a temperature slightly below a starting temperature of martensite formation and above the finishing temperature of the martensite formation, whereby a structure of the wire stock still contains residual austenite;

forming a wire coil; and subjecting the wire coil to isothermal condition under a hot top for a predetermined period of time at a temperature below the start temperature of martensite formation.

2. A method according to claim 1, wherein the wire coil forming step, comprises one of coiling the long-length wire stock; reeling the long-length wire stock; and forming, by using a laying head, wire winding subsequently collected to form a wire coil; and wherein the method further comprises the step of tempering the formed wire coil.

3. A method according to claim 1, wherein the cooling step is conducted after a finishing pass and before a start of statical recrystallization in the wire stock structure.

4. A method according to claim 1, wherein the cooling step comprises water-cooling of the wire stock.

* * * * *